US005640730A

United States Patent [19]

Godette

[11] Patent Number: 5,640,730

[45] Date of Patent: Jun. 24, 1997

[54] ADJUSTABLE ARTICULATED BED WITH TILTABLE HEAD PORTION

[75] Inventor: Robert G. Godette, Anaheim, Calif.

[73] Assignee: Maxwell Products, Inc., Cerritos, Calif.

[21] Appl. No.: 439,450

[22] Filed: May 11, 1995

[51] Int. Cl.[6] ..... A61G 7/00

[52] U.S. Cl. ..... 5/618; 5/617

[58] Field of Search ..... 5/618, 617, 616; 403/102, 113

[56] References Cited

U.S. PATENT DOCUMENTS

| | | | |
|---|---|---|---|
| D. 255,402 | 6/1980 | Lundgren . | |
| 4,258,445 | 3/1981 | Zur . | |
| 4,406,027 | 9/1983 | Bourch | 5/618 |
| 4,527,298 | 7/1985 | Moulton . | |
| 5,022,388 | 6/1991 | Harter | 5/618 |

FOREIGN PATENT DOCUMENTS

| | | |
|---|---|---|
| 379946 | 2/1983 | Austria . |
| 390178 | 2/1983 | Austria . |
| 2625086 | 6/1989 | France . |
| 2031471 | 6/1970 | Germany . |
| 3347388 | 12/1983 | Germany . |
| 8716122 | 12/1987 | Germany . |
| 8812984 | 10/1988 | Germany . |
| 8911224 | 9/1989 | Germany . |
| 8911656 | 9/1989 | Germany . |
| 9007914 | 2/1990 | Germany . |
| 9113757 | 11/1991 | Germany . |
| 4322151 | 7/1993 | Germany . |
| 9410304 | 6/1994 | Germany . |
| 9412497 | 8/1994 | Germany . |
| 9419433 | 12/1994 | Germany . |
| 326006 | 1/1958 | Switzerland . |
| 677067 | 12/1988 | Switzerland . |
| 682124 | 4/1991 | Switzerland . |

*Primary Examiner*—Steven N. Meyers
*Assistant Examiner*—Frederick Conley
*Attorney, Agent, or Firm*—Poms, Smith, Lande & Rose, P.C.

[57] ABSTRACT

An adjustable articulated bed having a back support section, a head rest section, an angled lifting lever, and a crank assembly operatively connecting the bed motor to the lifting lever. A slidable pin-and-slot arrangement connects the head end of the lever to the head rest section. As the lever is pivoted it first tilts the head rest section up relative to the (horizontal) back support section to a relative tilt position. Continued pivoting of the lever causes it to engage, lift and pivot the back support section up about the lifting-lever pivot axis. The head rest section, while maintaining the relative tilt position, is pivoted up with it. A polyfoam foundation affixed to the tops of both the back support and head rest sections tends to drag or lift the back support section up as the head rest section is pivoted up. A spring connected between the back support section and the crank assembly is provided to resist this lifting force, but not prevent the back support section from being lifted with the head rest section in its relative tilt position. Should a downward force be exerted at the end of the head rest section when horizontal (which force can be simply the weight of that section), a stop finger pivotal with the head rest section engages generally against the back support section to block downward pivoting of the head rest section. A bumper on a frame cross member provides a resilient stop for the downward travel of the lifting lever resulting from a downward force on or of the head rest section.

41 Claims, 7 Drawing Sheets

ADJUSTABLE ARTICULATED BED WITH TILTABLE HEAD PORTION

BACKGROUND OF THE INVENTION

The present invention relates to adjustable articulated beds and particularly those having a pivotally-adjustable back support section and a head rest or pillow section adjustably tiltable relative to the back support section.

Adjustable beds have been used for many years to alter the contours of top surfaces of mattresses to thereby controllably adjust the support on the different portions of the bodies of persons lying on them. This support adjustment can be for therapeutic purposes, for comfort reasons, or for the user's convenience, as when the user wants to sit propped up to read, eat or watch television. Originally, this adjustment was by manually-operated mechanical levers or cranks. Later, these manually-operated mechanical devices were replaced by one or more motors which powered the adjustable bed into the desired position through gear trains, chain drives, sprocket drives, and/or threaded shafts.

Adjustable beds are typically used in hospitals or convalescent homes by patients who must spend long periods of time in bed for health, injury or physical handicap reasons. The use of adjustable beds in private homes has increased markedly though in recent years. This is due to the popularity of home television and video viewing, the aging of the population and the technical advances which have been made in the construction, operation and capabilities of adjustable beds. Examples of adjustable beds are shown in U.S. Pat. Nos. 4,381,571 (Elliott), 4,385,410 (Elliott et al.), and 4,407,030 ('030 Elliott), in copending U.S. applications Ser. Nos. 8/213,675 and 08/404,326, and in PCT International Applications PCT/US95/03121 and PCT/US95/03171. Each of these patents, applications and all other patents, publications and applications mentioned anywhere in this disclosure are hereby incorporated by reference in their entireties.

In addition to having the back section of the bed being pivotally adjustable relative to the seat section thereof, it is also often desirable to have the head support section to be pivotally adjustable relative to the back section. By tilting the head support section up and thereby raising the user's head up (relative to his back) he can be more comfortably positioned for reading, eating, watching television or conversing with others. Where the bed is not equipped with a mechanical head tilt, the user has to prop up numerous pillows behind his head, which can be uncomfortable or inconvenient. Where the user has neck, head and/or back problems, "pillow propping" can be cumbersome or even injurious. Thus, a more accurate, controllable and easy head tilt system is desirable. Some prior art articulated adjustable beds having adjustable head sections are shown in U.S. Pat. Nos. 4,349,924 (Zur) ('924) and 4,535,492 (Sebest), Swiss Patent No. 326006 (Korber), and German Patent Nos. G.91.13.757.8 (Franke GmbH & Co. kG) ("German '757") and G.94.12.497.3 (Franke GmbH & Co. kG) ("German '497"). Other adjustable beds having upper adjustable sections are shown in U.S. Pat. Nos. D255,402 (Lundgren), 3,051,965 (Szemplak et al.), 4,258,445 (Zur) and 4,527,298 (Moulton), and German Patent No. 2.031.471 (Schmutz).

SUMMARY OF THE INVENTION

Directed to remedying the problems and disadvantages of the prior art, the present bed uniquely incorporates an adjustable head rest section utilizing an (or rather a pair of) angled lifting lever(s) (utilizing principles generally similar to German '757) into an adjustable articulated bed, which is similar to '030 Elliott. The angled lifting lever has its pivot axis coincident with the pivot axis of the back support section. An offset pivot axis causes unnecessary and disadvantageous relative motion, which can require a slot or C-section structure to capture a joint. The angled head end of the lever is operatively connected to the head rest section with a sliding-pin-and-slot arrangement. More specifically, as the lifting lever is pivoted a pin at the head end acts through a longitudinal slot formed in a bracket formed downward from the head rest section to lift that section to an upwardly-angled position relative to the horizontal back support section. The upwardly-angled position is generally forty-five degrees above horizontal. The pin slides in the longitudinal slot as the head rest section is lifted. Continued pivoting of the lifting lever by the bed motor causes a tab on its top surface to engage and lift the back support section (and together therewith the upwardly-angled head rest section) about the pivot axis to an inclined (or reclined) angle of generally sixty degrees.

A continuous mat of thick rubber foam or polyfoam material is supported on and secured to the head rest section and the back support section. Thus, as the head rest section is pivoted, the mat pulls on and tends to lift the back support section with it. To prevent this, a spring is attached at one end to the back support section and at an opposite end to a crank assembly operatively connecting the motor to the lifting lever. When the lifting lever engages the back support section and pivots it, the crank assembly is also pivoted so the spring does not prevent the back support system from pivoting.

With both the head rest and back support sections in horizontal flat orientations, a heavy person may decide to sit on the head end of the bed (the cantilevered edge of the head rest section), thereby exerting a large down force. This force may even be simply from the weight of the head rest section itself. This causes a moment about the pivotal connection of the head rest section to the back support section, defined by a pin extending through aligned openings in bracket ears secured to and hanging down from both sections. An elongate stop member or finger extending rearwardly from the head-rest bracket ear engages the back-support bracket ear by the moment force, thereby preventing further downward pivoting of the head rest section. Also, the downward force forces the lifting lever downward to engage a resilient bumper mounted on a bed frame cross brace.

A center seat section is fixed relative to the bed frame. The back support section is pivotal relative to a head end of the seat section and a thigh section is pivotal relative to a foot end of the seat section. A lower leg section is pivotal at the foot end of the thigh section. The sections can be lifted and pivoted relative to each other by operating a remote hand-held control, such as the "R2-T" control available from Maxwell Products, Inc. of Cerritos, Calif.

Other objects and advantages of the present invention will become more apparent to those persons having ordinary skill in the art to which the present invention pertains from the foregoing description taken in conjunction with the accompanying drawings.

DETAILED DESCRIPTION OF PREFERRED EMBODIMENTS OF THE INVENTION

Figure 1:
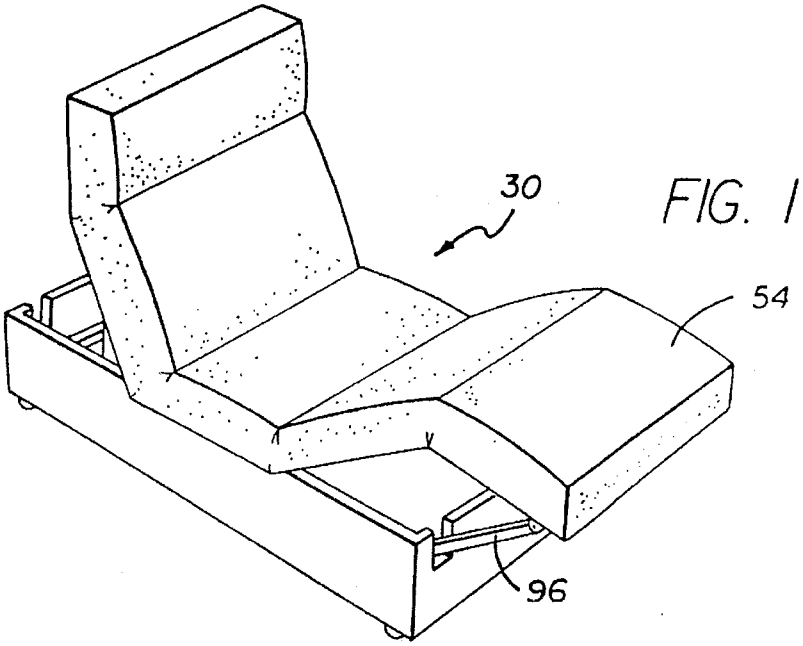
FIG. 1 is a simplified perspective view of an adjustable articulated bed of the present invention in a head and foot end lifted configuration.
Figure 3:
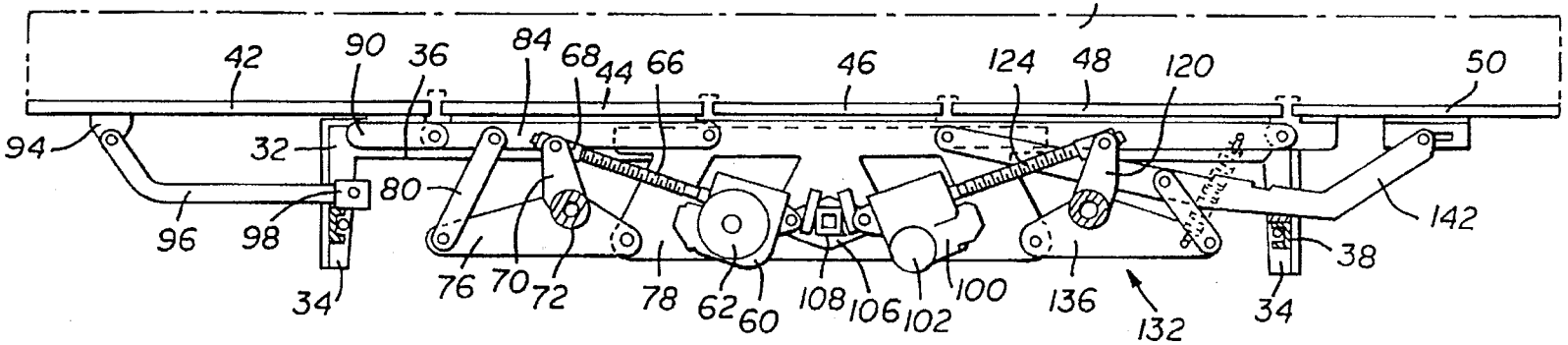
FIG. 3 is a reduced cross-sectional view taken on line 3—3 of FIG. 2 of the full length of the bed.

Referring to the drawings, an adjustable articulated bed having a tiltable head rest section is shown generally at 30. Bed 30 includes a bed frame 32 having corner posts 34, a pair of opposite longitudinal rails 36 and a pair of opposite cross braces 38. Supported on and by the bed frame 32, and as best shown in FIG. 3, are a lower leg section 42, a thigh section 44, a seat section 46, a back support section 48, and a head rest section 50. Each is pivotally connected to the adjacent section or sections. Each can include a board or other planar member made of plywood material, for example. A foundation mat 54 extends the length and width of the bed 30 and is supported by these sections. The mat 54 can be articulated or bendable as shown in FIG. 1 and can be made of polyfoam material. The mat 54 is affixed to each of these sections by gluing or preferably using a foundation cover which is stapled into position. The finished bed would also include a mattress (not shown) supported on the polyfoam foundation.

The seat section 46 is affixed relative to the frame 32, the thigh section 44 pivots at its head end relative to the seat section and the lower leg section 42 pivots relative to the foot end of the thigh section. The thigh and lower leg sections 44, 42 are manipulatable in a manner similar to that described in the '030 patent. They are positionable, for example, as to place the foundation 54 supported thereon in an orientation such as shown in FIG. 1. The back support section 48 and the head rest section 50 are also pivotal relative to the seat section 46 to position the foundation 54 thereon in a number of different positions, one of which is shown in FIG. 1 and others of which will be described in detail later in this disclosure. The thigh section 44 and the lower leg section 42 are manipulatable by operation of a first motor shown in FIG. 3.

The drive gear 60 and the first motor 62 when operated rotates a drive shaft 66 which moves a nut or bushing 68 along the shaft. The motor 60 is positioned generally on the longitudinal centerline of the bed frame 32 and pivots, through a mounting arm 70, a torque tube 72. At either end of the torque tube 72 are secured triangular plates 76 moveable therewith and pivotally coupled to a central support section 78 of the frame 32 at one end. A pivot link 80 is pivotally coupled at one end thereof to the triangular plate 76 and at the other end to a bracket 84 mounted under the thigh section 44. Thus, as the drive shaft 66 turns, the nut 68 is driven back towards the motor 60 causing the triangular plates 76 to pivot about their pivotal connections to support section 78 and thereby lift the pivot links 80 at the opposite ends to thereby lift the thigh section 44. The thigh section 44 in turn is pivotally coupled with a link 90 to a mounting bracket underneath the lower leg section 42 to be raised therewith. The foot end of the lower leg section 42 is coupled with a pivotal hinge 94 to a J-shaped pivotal linkage 96 and the pivotal linkage in turn is coupled to a hinge 98 supported by the frame 32. This allows a movement of the lower leg section 42 as can be understood from FIG. 1.

Figure 2:
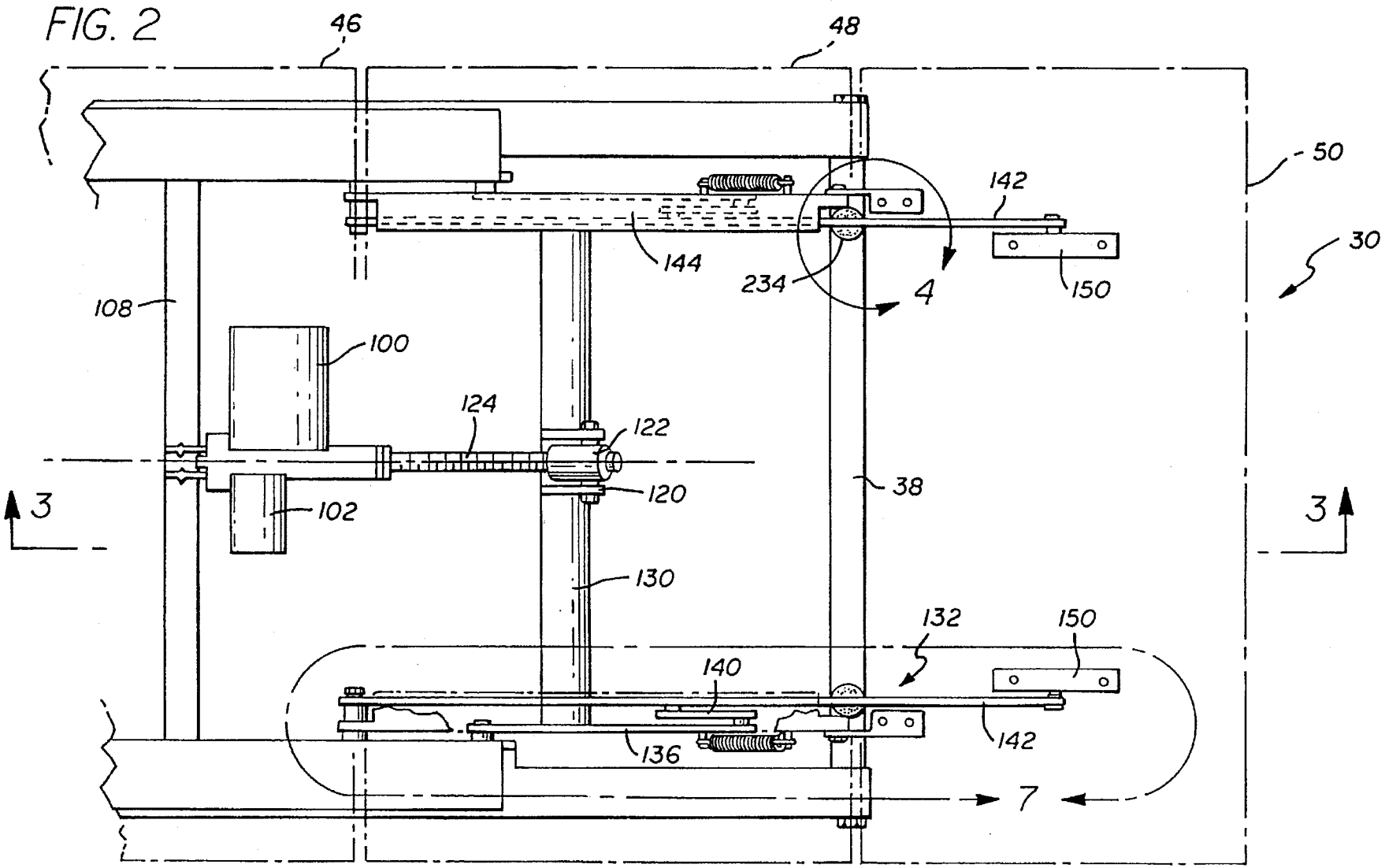
FIG. 2 is an enlarged top plan view of a head portion of the bed of FIG. 1 in a flat orientation and with portions broken away, the mattress foundation omitted and the support boards shown in dotted lines for illustrative purposes.
Figure 7:
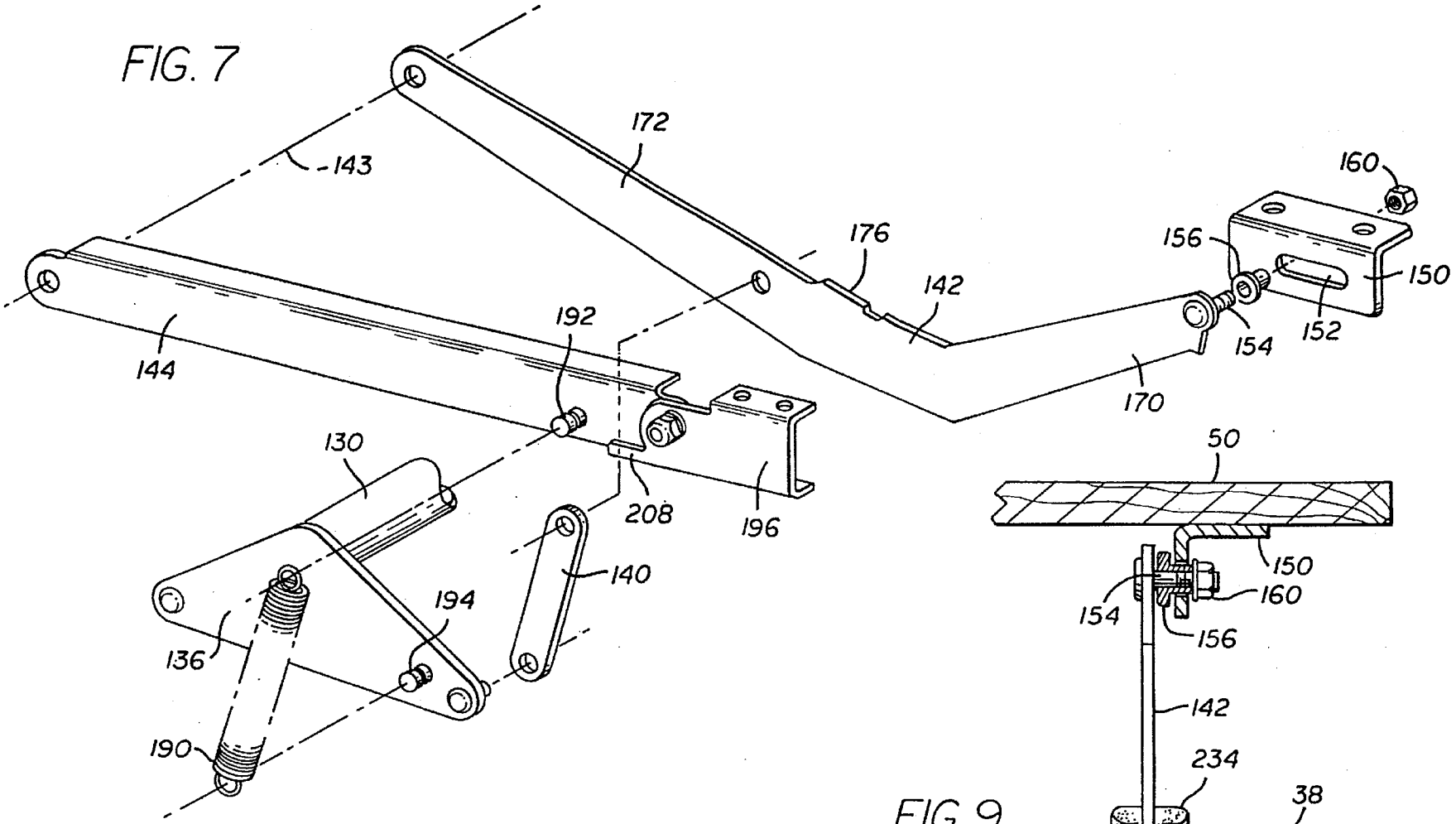
FIG. 7 is an enlarged exploded perspective view taken generally on circle 7 of FIG. 2.
Figure 9:
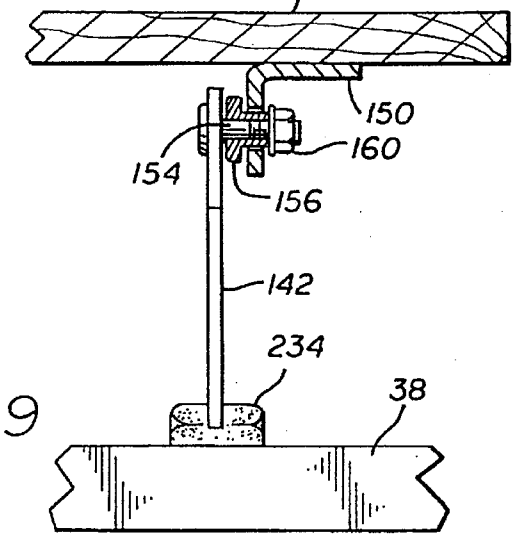
FIG. 9 is an enlarged cross-sectional view taken on line 9—9 of FIG. 8.

A second motor 100 having a motor capacitor housing 102 is supported by and pivotally coupled to a motor-connecting plate 106 which is supported in turn by a lateral support member 108 of the frame 32. The second motor 100 can be an AC motor available from FASCO of St. Louis, Mo. A mounting arm 120 is secured to a nut 122 which travels along the drive shaft 124 of the motor. As the nut 122 travels, the mounting arm 120 turns, causing the forward torque arm 130 to be rotatably lifted. At either end of the torque arm 130 are a pair of crank assemblies 132, which are identical mirror images of one another, as can be seen in FIG. 2. See also FIG. 7. The corresponding elements of each crank assembly 132 will thus be designated by the same reference numeral. Each includes a triangular crank plate 136 pivotally secured at its foot end to a central support section 78 of the frame 32. A pivot link 140 is pivotally secured at the forward corner and pivotally secured at its opposite end to an angled lifting lever 142. The angled lifting lever 142 is pivotally secured about a first pivot axis 143 (FIG. 7) at its foot end to the foot end of an angled bracket 144 mounted underneath and to the back support section 48 and as shown in FIG. 7 for example. Another angled bracket 150 is mounted underneath and to the head rest section 50 at a central location thereof and includes a longitudinal elongate slot 152. A bolt 154 at the head end of the lifting lever 142 fitted into a bushing or cap 156 extends into the slot 152 and is held therein with a nut 160 as shown in FIGS. 7 and 9.

Figure 10:
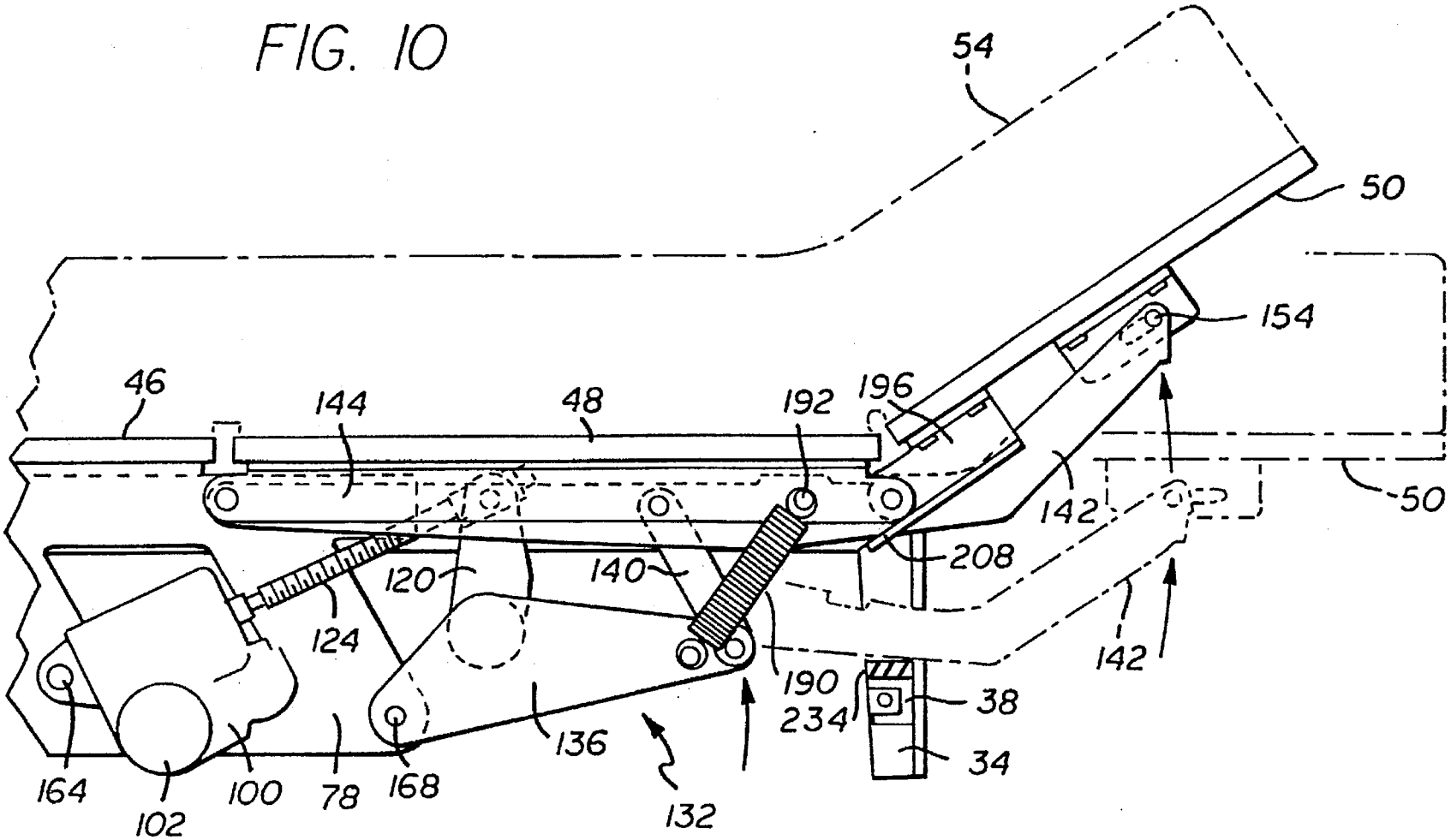
FIG. 10 is a view similar to FIG. 8 showing the bed moved to a head section tilt position.

Thus, as the motor 100 is operated, the drive shaft 124 is rotated and the nut 122 is caused to travel along the drive shaft, and the motor pivots about its pivotal mount 164 via the motor connecting plate 106 (FIG. 3). The mounting arm 120 attached to the nut 122 moves thereby moving the torque arm 130. As the torque arm 130 moves, it causes the triangular plates 136 at either end thereof to rotate about their foot end pivotal connections 168. Referring to FIG. 10, this rotation about the pivotal connections 168 lifts the pivot link 140 which thereby lifts the angled lifting lever 142 causing it to pivot about its pivotal connection to the mounting bracket 144 on the back support section 48.

Figure 12:
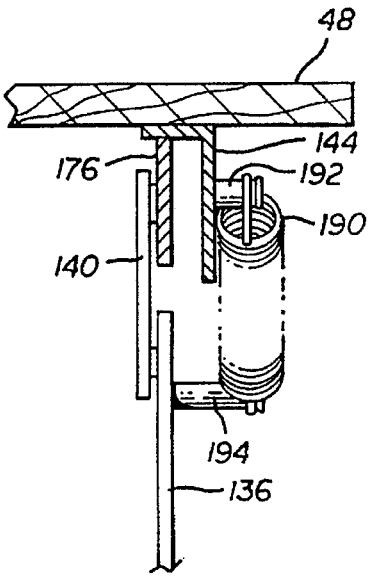
FIG. 12 is an enlarged cross-sectional view taken on line 12—12 of FIG. 11.
Figure 11:
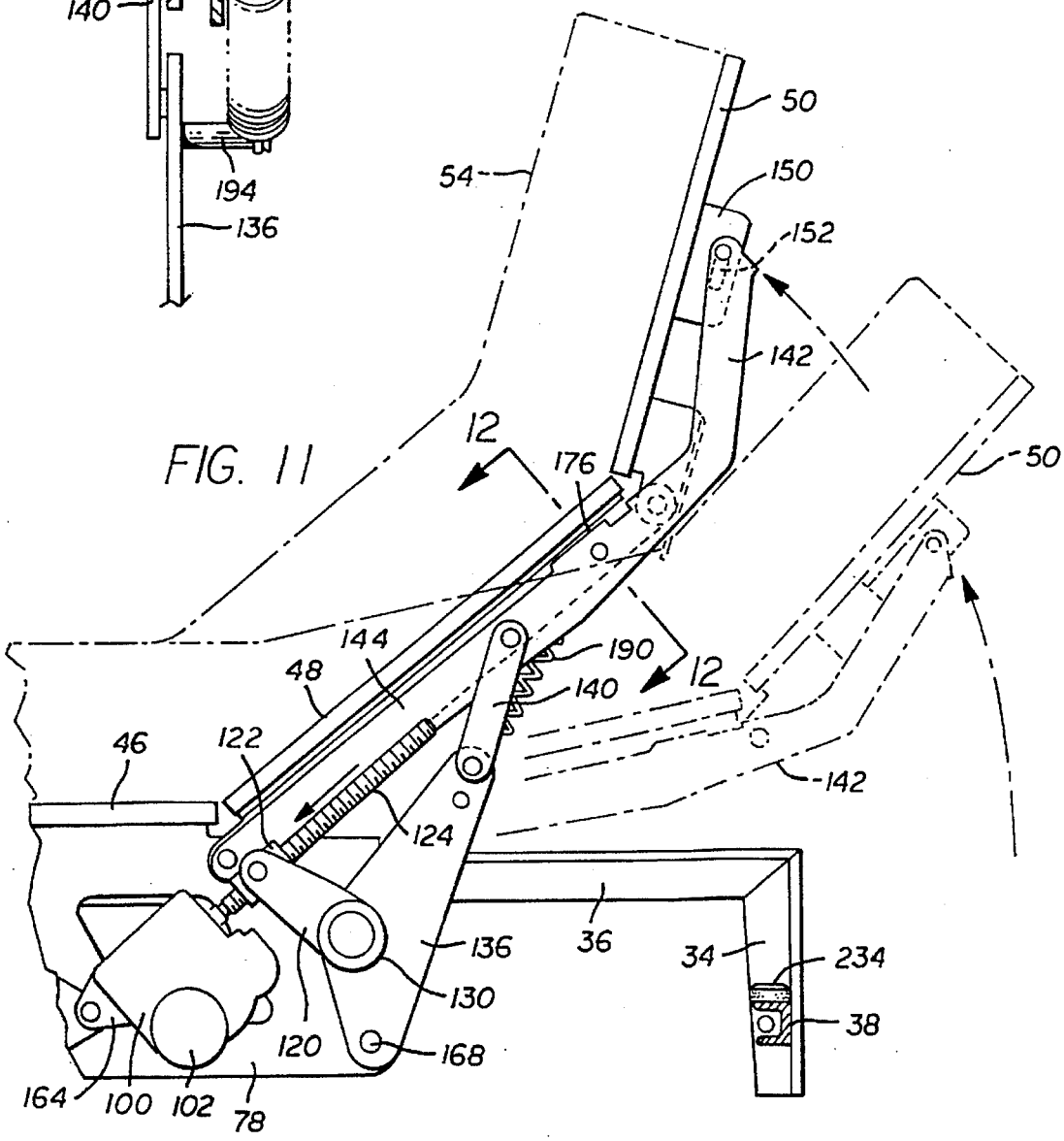
FIG. 11 is a view similar to FIG. 10 showing the bed moved to a back section tilt position.

As the angled lifting lever 142 is pivoted, it first through its upwardly angled head end 170 (FIG. 7) lifts the head rest section 50 to a tilted up position as shown by the solid lines on the right hand side of FIG. 10. As the lifting lever 142 is lifted, the sliding pin or bolt 154 at its end slides in the elongate slot 152 and lifts the head rest section 50 up pivotally about the second pivot axis. It lifts it up approximately forty-five degrees. At that point the elongate foot end section 172 (FIG. 7) of the lifting lever 142 is approximately parallel to and underneath the back support section 48. Further pivotal movement causes an upper surface tab 176 of the lifting lever 142 to engage underneath the back support section 48 and lift the back support section up about the first pivot axis 143. This movement and contact are best shown in FIGS. 11 and 12. As can be understood from FIG. 11, as the back support section 48 is lifted, the head rest section 50 maintains its angular relationship relative thereto. During the upward movement of the back support section 48, the sliding pin 154 at the end of the lifting lever 142 is at the far head end of the slot 152. As can be understood, both of the crank assemblies 132 on either side of the bed 30 operate on their respective lifting levers 142 through the torque tube 130 to simultaneously act on and lift the head rest section 50 and then subsequently the back support section 48.

This two stage movement is desirable. When the back support section 48 has been pivotally inclined, the usual desirable position of the head rest section 50 is in an angled position relative thereto to further raise the user's head to a more vertical position for viewing television, eating or the like, as can be understood from FIG. 11. Similarly, with the back support section 48 horizontal, the head rest section 50 can be horizontal, as shown in FIGS. 3 and 8, so that the user can sleep or rest, or alternatively the head rest section can be tilted for reading or the like, as shown in FIG. 10.

As the head rest section 50 is tilted from a horizontal to its angled position the foundation 54 affixed thereto is similarly lifted. The foundation 54 is also affixed to the back support section 48 and thus due to the resistance provided by the thick mat the back support section would tend to also be pivoted up with the head rest section 50. This is undesirable. Accordingly, the present invention includes a coil spring 190 (or ram) attached at one end by a weld bolt 192 to the mounting bracket 144 beneath the back support section 48 and at its other end to the triangular plate 136 at a weld bolt 194 location adjacent to the connection to the pivot link 140. An example of a coil spring 190 is an extension spring available from Century Spring Company of Los Angeles, Calif., made of spring steel and having a high load output. The spring 190 then pulls down against the back support section 48 counteracting this lifting movement from the affixed mat 54. However, as the lifting lever 142 then directly engages the back support section 48, the resisting force provided by the spring 190 together with the pivoting action of the triangular plate 136 does not prevent the back support section 48 from pivoting to its inclined position. It does provide a minimal resistance thereto as can be appreciated by reference to FIG. 11 which shows the spring 190 being in a stretched condition.

Figure 5:
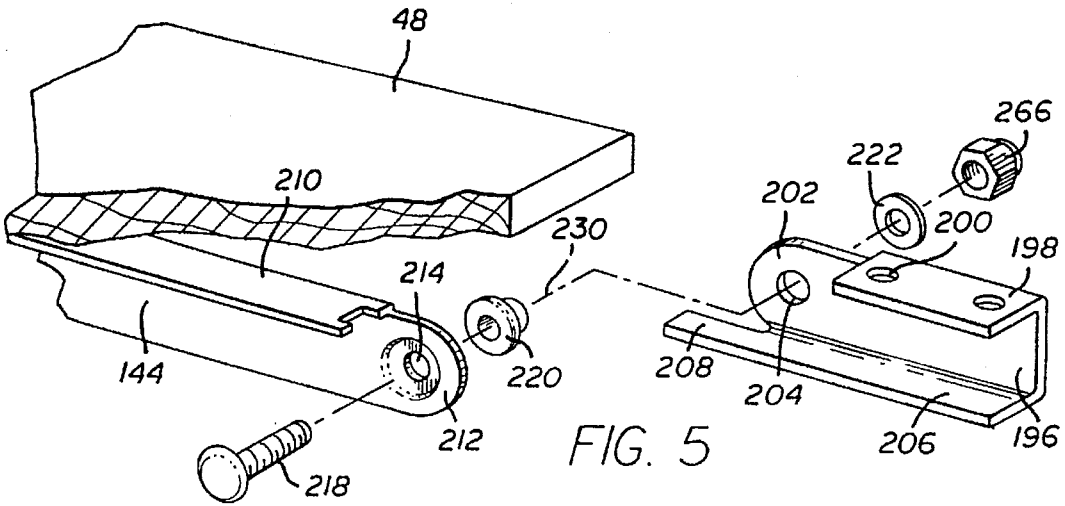
FIG. 5 is an exploded perspective view illustrating the pivotal mounting of the pivotal stop member of FIG. 4.
Figure 4:
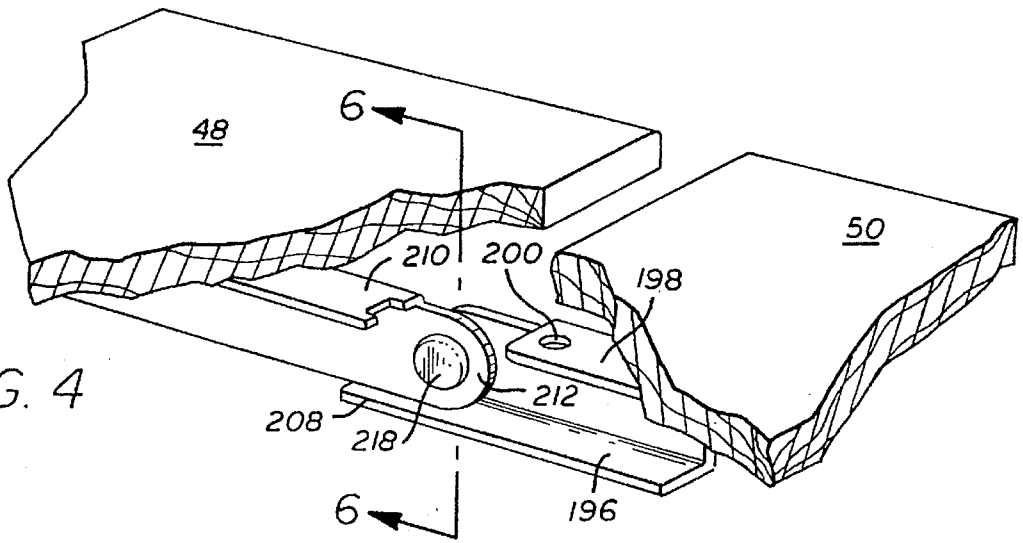
FIG. 4 is an enlarged, partially-sectional perspective view taken generally on circle 4 of FIG. 2.
Figure 6:
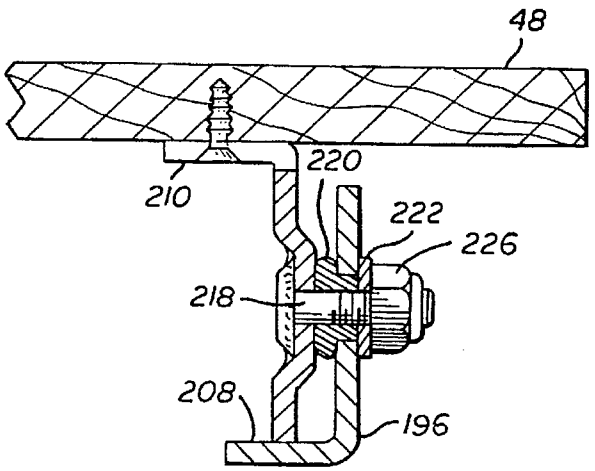
FIG. 6 is a cross-sectional view taken on line 6—6 of FIG. 4.

Referring to FIGS. 4–6, for example, the pivotal stop bracket assembly is shown at 196. It forms a C shape with its top flange 198 having holes 200 through which screws pass for securing it to the underneath side of the head rest section 50. At its foot end it includes a rounded ear 202 (FIG. 5) having a lateral through-hole 204. Its bottom flange 206 includes a rearwardly-extending flat finger 208 whose purpose will be described later. The mounting bracket 144 secured underneath the back support section 48 includes a top securing flange 210 (through which screws 211 as shown in FIG. 6 can pass into the back support section 48) and a head-end rounded ear 212 having a through-opening 214 (FIG. 5). The two ears 202, 212 are aligned and a bolt 218 is passed through one opening 214 into a bushing 220 and into the other opening 204, then through a washer 222 and a securing nut 226. The nut 226 is threaded onto the bolt 218 but not so tightly as to rigidly lock the two ears 202, 212 together. Rather, they are allowed to pivot about the bolt 218 with respect to each other. This pivoting can be seen by comparing the relative positions of the pivotal stop assembly 196 relative to the back support section bracket 144 in FIGS. 8 and 10. This bolt 218 thereby defines the second pivot axis 230 as shown in FIG. 5.

Figure 8:
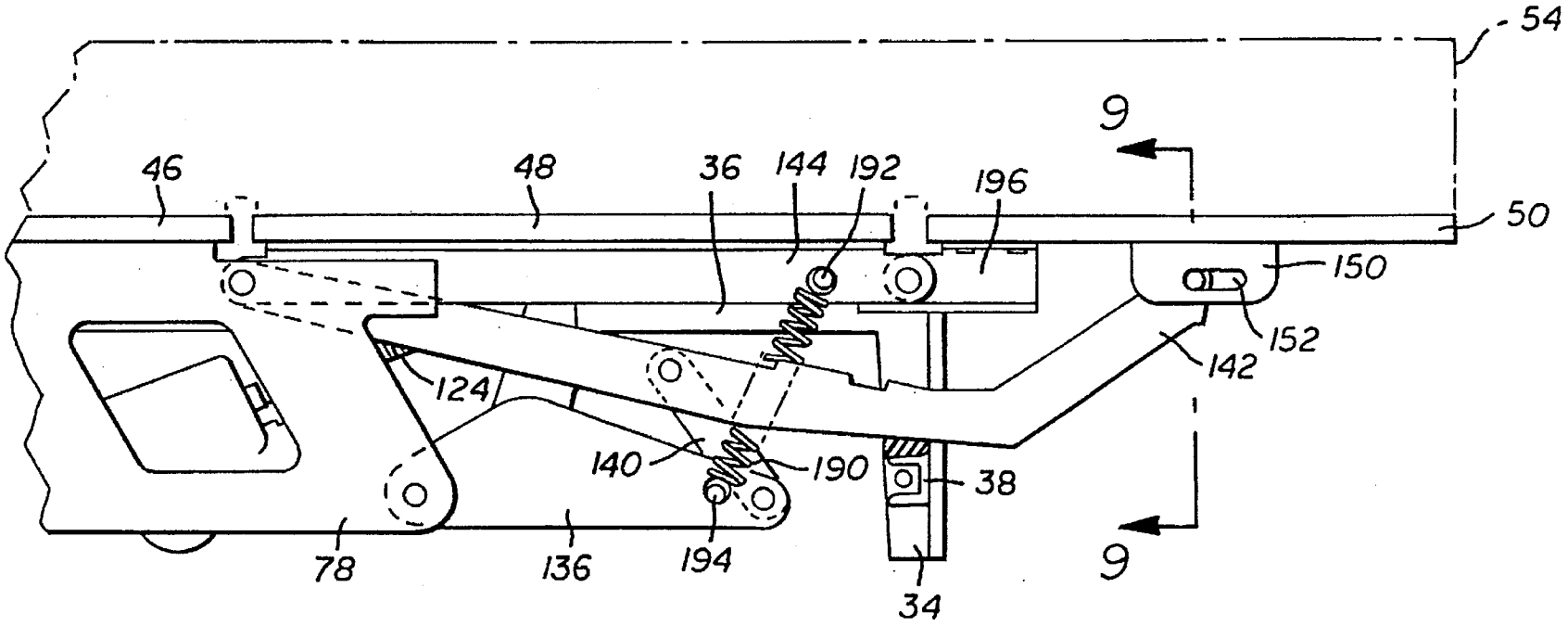
FIG. 8 is an enlarged side elevational view of a head portion of the bed in a flat orientation.

With the head rest section 50 and thereby also the back support section 48 in horizontal normal positions as shown in FIG. 8, and a downward force applied to the head rest section a moment will be exerted about the second pivot axis. Depending upon the specific bed construction, this need not be a heavy force such as when a obese person plops himself down, but can rather be simply the weight of the head rest section 50 itself. If this moment were not counteracted, the head rest section 50 would simply pivot or fall downward. However, the previously-mentioned finger 208 is provided to engage and act upon the back support section bracket 144 as can be understood by looking at the engaged position in FIGS. 4, 7 and 8. The finger 208 is preferably mounted to the bracket 196 on the head-rest section 50 because of manufacturing ease, but could alternatively be secured to the bracket 144 on the back support section 48 and extend towards the head end of the bed. Additionally, the lifting lever 142 is caused to contact or impact (depending upon the bed construction and the forces involved), a rubber stop or other resilient member 234 secured to and on top of the cross brace. This is shown, for example, in FIGS. 2 and 8.

From the foregoing detailed description, it will be evident that there are a number of changes, adaptations and modifications of the present invention which come within the province of those skilled in the art. However, it is intended that all such variations not departing from the spirit of the invention be considered as within the scope thereof as limited solely by the claims appended hereto.

What is claimed is:

1. An adjustable articulated bed, comprising:

a bed frame;

a back support section pivotal about a pivot axis at a first end thereof, relative to said bed frame;

a head rest section pivotally connected to said back support section;

a slot-supporting member extending generally down from said head rest section and having a longitudinal slot;

a lifting lever pivotal at a foot end thereof about the pivot axis and having an upwardly-angled head end portion;

a sliding member secured to a head end of said upwardly-angled head end portion and positioned for sliding movement in said slot;

a motor operatively connected to said lifting lever to pivot same about the pivot axis such that (1) with said back support section general horizontal, said head rest section is pivoted via said sliding member from a generally horizontal orientation up to an upwardly-angled position relative to said back support section and (2) then said back support section together with said head rest section in the upwardly-angled position to a pivoted-up position about the pivot axis;

wherein said sliding member slides along said slot as said head rest section is pivoted up from the generally horizontal orientation to the upwardly-angled position;

wherein said back support section includes a longitudinal downwardly-formed bracket having a foot end through which the pivot axis passes and a head end defining therethrough a pivot axis of said head rest section;

a foundation supported at least in part on said back support section and said head rest section;

wherein said foundation is affixed to said back support section and said head rest section; and bias spring means connected to said back support section at one end thereof for biasing said back support section in a horizontal orientation against a lifting action from said affixed foundation as said head rest section is pivoted to the upwardly-angled position.

2. The bed of claim 1 wherein said lifting lever includes an upwardly-formed tab on an upper surface thereof which contacts said back support section with said lifting lever pivoting said back support section to the pivoted-up position.

3. The bed of claim 1 wherein said slot-supporting member comprises an angled bracket secured underneath and to said head rest section at a longitudinally central location thereof.

4. The bed of claim 1 wherein said motor includes a drive shaft, and further comprising a torque arm assembly operatively connected to said drive shaft and to said lifting lever to transmit a rotational force of said drive shaft to a pivoting movement of said lifting lever about the pivot axis.

5. The bed of claim 1 further comprising a crank assembly operatively connecting said motor to said lifting lever, and said bias spring means is connected on an opposite end thereof directly to said crank assembly.

6. The bed of claim 1 wherein said sliding member includes a lateral, outwardly-disposed pin.

7. An adjustable articulated bed, comprising:

a bed frame;

a back support section pivotally attached about a first pivot axis at a foot end thereof to said bed frame;

a head rest section pivotal about a second pivot axis at a foot end thereof to a head end of said back support section, said head rest section including a portion having a slot;

a lifting lever pivotal about a lifting-lever pivot axis, said lifting lever having an elongate foot portion and an upwardly-angling head portion;

a crank assembly;

a motor operatively connected via said crank assembly to said lifting lever such that when said motor is operated said crank assembly is turned and said lifting lever is thereby pivoted about the lifting-lever pivot axis, thereby pivoting said head rest section about the second pivot axis upwardly to an angled position relative to said back support section and then pivoting said back support section together therewith in the angled position upwardly about the first pivot axis; and an elongate resilient member connected at one end thereof to said back support section at a head portion thereof and at an opposite end to said crank assembly and pivotal therewith, said elongate resilient member providing a resisting force to an upward pivoting of said back support section due to a lifting force exerted as said head rest section is pivoted up to the angled position;

wherein the lifting-lever pivot axis is coincident with the first pivot axis.

8. The bed of claim 7 wherein said elongate resilient member comprises a coil spring.

9. The bed of claim 7 wherein said crank assembly includes a crank plate pivotally secured relative to said frame, a mounting arm affixed to said crank plate at one end and operatively driven by said motor at another end, and a pivot link pivotally connected at one end to said crank plate and at another end to said lifting lever.

10. The bed of claim 9 wherein an opposite end of said elongate resilient member is secured directly to said crank plate at a location spaced a distance from an affixing location of said arm to said crank plate.

11. The bed of claim 9 wherein said motor includes a drive shaft and a bushing on said drive shaft, and said mounting arm is attached to said bushing and movable therewith along said drive shaft.

12. The bed of claim 7 wherein the lifting-lever pivot axis is fixed relative to said bed frame.

13. The bed of claim 7 further comprising a seat section supported by said bed frame, a thigh section pivotal relative to said seat section and a lower leg section pivotal relative to said thigh section, and wherein said back support section is pivotal relative to said seat section.

14. The bed of claim 7 further comprising a foundation supported in part by said head rest section and said back support section.

15. An adjustable articulated bed, comprising:

a bed frame including a cross brace;

a back support section pivotally attached about a first pivot axis at a foot end thereof to said bed frame;

a head rest section pivotally attached about a second pivot axis at a foot end thereof to a head end of said back support section;

a lifting lever pivotal about a lifting-lever pivot axis, said lifting lever having an elongate foot portion and an upwardly-angling head portion;

a motor operatively connected to said lifting lever such that when said motor is operated said lifting lever is pivoted about the lifting-lever pivot axis thereby pivoting said head rest section about the second pivot axis upwardly to an angled position relative to said back support section and then pivoting said back support section and said head rest section together therewith in the angled position upwardly about the first pivot axis; and a resilient bumper mounted on top of said cross brace and down against which a lower surface of said elongate foot portion of said lifting lever impacts;

wherein the lifting-lever pivot axis is coincident with the first pivot axis and fixed relative to said bed frame.

16. The bed of claim 15 further comprising a bracket secured to said head support section and defining a slot and a pin secured to said upwardly-angling head portion, disposed in said slot and riding in said slot as said head rest section is pivoted about the second pivot axis.

17. The bed of claim 15 further comprising a seat section supported by said bed frame, a thigh section pivotal relative to said seat section and a lower leg section pivotal relative to said thigh section, and wherein said back support section is pivotal relative to said seat section.

18. The bed of claim 15 further comprising a foundation supported in part by said head rest section and said back support section.

19. An adjustable articulated bed, comprising:

a bed frame;

a back support section pivotal about a first pivot axis at a first end thereof, relative to said bed frame;

a first bracket secured to said back support section and having at a head end thereof a first ear;

a head rest section;

a second bracket secured to said head rest section and having at a foot end thereof a second ear;

a member pivotally connecting about a second pivot axis said first and second ears together such that said head rest section is pivotal relative to said back support section about the second pivot axis;

a lifting lever pivotal at a foot end thereof about the first pivot axis and having an elongate foot portion and an upwardly-angling head portion; and a motor operatively connected to said lifting lever to pivot same about the first pivot axis such that (1) with said back support section generally horizontal, said head rest section is pivotal by said upwardly-angling head portion from a generally horizontal orientation up to an upwardly-angled position relative to said back support section and (2) then said back support section together with said head rest section in the upwardly-angled position can be pivoted to a pivoted-up position about the first pivot axis;

wherein one of said first and second brackets includes an elongate projecting stop finger positioned to engage the other of said first and second brackets as said head rest section is pivoted from the upwardly-angled position back down to a generally horizontal orientation and to block further pivoting below that orientation;

wherein said first bracket has an opening at a foot end thereof defining the first pivot axis; and spring means operatively connected to said back support section for biasing said back support section down in the generally horizontal position as said head rest section is pivoted up to the upwardly-angled position.

20. The bed of claim 19 wherein said one of said first and second brackets is said second bracket.

21. The bed of claim 19 further comprising a sliding-pin-and-slot arrangement operatively connecting said upwardly-angled end portion to said head rest section.

22. The bed of claim 19 further comprising a crank assembly operatively connecting said lifting lever to said back support section, and wherein said spring means comprises a coil spring secured at one end to said back support section and at an opposite end to said crank assembly.

23. The bed of claim 19 wherein said member comprises a bolt passing through aligned openings in said first and second ears.

24. The bed of claim 19 wherein said one of said brackets is said second bracket, and said elongate projecting stop finger lies in a plane perpendicular to a plane of said second ear.

25. An adjustable articulated bed, comprising:

a bed frame;

a back support section pivotal about a pivot axis at a first end thereof, relative to said bed frame;

a head rest section pivotally connected to said back support section;

a slot-supporting member extending generally down from said head rest section and having a longitudinal slot;

a lifting lever pivotal at a foot end thereof about the pivot axis and having an upwardly-angled head end portion;

a sliding member secured to a head end of said upwardly-angled head end portion and positioned for sliding movement in said slot;

a motor operatively connected to said lifting lever to pivot same about the pivot axis such that (1) with said back support section general horizontal, said head rest section is pivoted via said sliding member from a generally horizontal orientation up to an upwardly-angled position relative to said back support section and (2) then said back support section together with said head rest section in the upwardly-angled position to a pivoted-up position about the pivot axis;

wherein said sliding member slides along said slot as said head rest section is pivoted up from the generally horizontal orientation to the upwardly-angled position;

a foundation supported at least in part on said back support section and said head rest section;

wherein said foundation is affixed to said back support section and said head section;

bias spring means connected to said head rest section at one end thereof for biasing said head rest section in a horizontal orientation against a lifting action from said affixed foundation as said head rest section is pivoted to the upwardly-angled position; and a crank assembly operatively connecting said motor to said lifting lever, and said bias spring means is connected on an opposite end thereof directly to said crank assembly.

26. An adjustable articulated bed, comprising:

a bed frame;

a back support section pivotally attached about a first pivot axis at a foot end thereof to said bed frame;

a head rest section pivotal about a second pivot axis at a foot end thereof to a head end of said back support section, said head rest section including a portion having a slot;

a lifting lever pivotal about a lifting-lever pivot axis, said lifting lever having an elongate foot portion and an upwardly-angling head portion;

a crank assembly;

a motor operatively connected via said crank assembly to said lifting lever such that when said motor is operated said crank assembly is turned and said lifting lever is thereby pivoted about the lifting-lever pivot axis, thereby pivoting said head rest section about the second pivot axis upwardly to an angled position relative to said back support section and then pivoting said back support section together therewith in the angled position upwardly about the first pivot axis; and an elongate resilient member connected at one end thereof to said back support section at a head portion thereof and at an opposite end to said crank assembly and pivotal therewith, said elongate resilient member providing a resisting force to an upward pivoting of said back support section due to a lifting force exerted as said head rest section is pivoted up to the angled position;

wherein said crank assembly includes a crank plate pivotally secured relative to said frame, a mounting arm affixed to said crank plate at one end and operatively driven by said motor at another end, and a pivot link pivotally connected at one end to said crank plate and at another end to said lifting lever; and wherein an opposite end of said elongate resilient member is secured directly to said crank plate at a location spaced a distance from an affixing location of said arm to said crank plate.

27. An adjustable articulated bed, comprising:

a bed frame;

a back support section pivotal at a first end thereof relative to said bed frame;

a head rest section pivotally connected to said back support section;

a lifting lever pivotal at a foot end thereof about a pivot axis relative to said bed frame, said lifting lever having an upwardly-angled head end portion;

motor means for pivoting said lifting lever about the pivot axis such that (1) with said back support section generally horizontal, said head rest section is pivoted via said lifting lever to an upwardly-angled position relative to said back support section and (2) then said back support section together with said head rest section in the upwardly-angled position to a pivoted-up position about the pivot axis;

a foundation supported on and affixed to both of said back support and head rest sections; and bias means connected to said back support section for biasing said back support section in a horizontal orientation against a lifting action from said affixed foundation as said head rest section is pivoted to the upwardly-angled position.

28. The bed of claim 27 wherein said bias means has an end connected to said back support section and an opposite end secured to an opposite end connector of said bed, and said opposite end connector moves up as said lifting lever is pivoted up.

29. The bed of claim 28 wherein said connector is moved up as said head rest section is pivoted to the upwardly-angled position.

30. The bed of claim 29 wherein said connector is moved up as said back support section is pivoted to the pivoted-up position.

31. The bed of claim 28 wherein said connector is moved up as said back support section is pivoted to the pivoted-up position.

32. The bed of claim 28 wherein said motor means includes a motor and a crank assembly cooperatively connecting said motor to said lifting lever, and said opposite end connector is on said crank assembly.

33. The bed of claim 32 wherein said crank assembly pivots about an axis and said connector is spaced a distance away from the axis.

34. The bed of claim 32 further comprising a sliding-pin-and-slot arrangement operatively connecting said upwardly-angled head end portion to said head rest section.

35. The bed of claim 27 further comprising a first bracket secured to said back support section and having a first ear, a second bracket secured to said head rest section, and having a second ear, and a member pivotally connecting about a connector pivot axis said first and second ears together such that said head rest section is pivotal relative to said back support section about the connector pivot axis, wherein one of said first and second brackets includes a projecting finger positioned to engage the other of said first and second brackets as said head rest section is pivoted from the upwardly-angled position back down to a generally horizontal orientation and to block further pivoting below that orientation.

36. The bed of claim 35 wherein said one of said first and second brackets is said second bracket.

37. The bed of claim 35 wherein the connector pivot axis is fixed relative to said first and second ears.

38. The bed of claim 35 wherein said member comprises a bolt passing through aligned openings in said first and second ears.

39. The bed of claim 27 further comprising said frame including a cross brace, said lever having a foot portion adjacent said upwardly-angled portion, and a resilient bumper mounted on top of said cross brace and down against which a lower surface of said foot portion impacts.

40. The bed of claim 27 wherein said back support section is pivotal about the pivot axis of said lifting lever.

41. The bed of claim 27 wherein said lifting lever includes an upwardly-formed tab on an upper surface thereof which contacts said back support section with said lifting lever pivoting said back support section to the pivoted-up position.

* * * * *